US005305883A

United States Patent [19]

Gage et al.

[11] Patent Number: 5,305,883

[45] Date of Patent: Apr. 26, 1994

[54] METHOD AND APPARATUS FOR STACKING CARTONS

[75] Inventors: John C. Gage, Orlando; A. Mark Gage, Minneola, both of Fla.

[73] Assignee: Bruce S. Bialor, Temple Terrace, Fla. ; a part interest

[21] Appl. No.: 947,556

[22] Filed: Sep. 21, 1992

[51] Int. Cl.[5] ..... B65D 5/42

[52] U.S. Cl. ..... 206/511; 206/509; 229/915

[58] Field of Search ..... 229/DIG. 11, 915; 206/509, 511, 512

[56] References Cited

U.S. PATENT DOCUMENTS

| | | | |
|---|---|---|---|
| 568,122 | 7/1897 | Gale . | |
| 1,514,512 | 11/1924 | Fisher | 229/DIG. 11 |
| 2,198,106 | 4/1940 | Chandonia | 206/511 |
| 2,256,024 | 9/1941 | Hill | 229/DIG. 11 |
| 2,594,628 | 4/1952 | Evans | 229/915 |
| 3,017,064 | 1/1962 | Davis | 206/511 |
| 3,287,075 | 11/1966 | Batke et al. | 229/DIG. 11 |
| 3,544,021 | 12/1970 | Wilson . | |
| 3,552,579 | 1/1971 | Simon et al. | 229/915 |
| 4,266,714 | 5/1981 | Crane | 229/915 |
| 4,932,530 | 6/1990 | von Zuben et al. . | |

FOREIGN PATENT DOCUMENTS

| | | | |
|---|---|---|---|
| 3937263 | 5/1991 | Fed. Rep. of Germany | 229/915 |
| 1407172 | 6/1965 | France | 229/DIG. 11 |
| 1438281 | 4/1966 | France | 229/DIG. 11 |

*Primary Examiner*—Gary E. Elkins

*Attorney, Agent, or Firm*—Allen, Dyer, Doppelt, Franjola & Milbrath

[57] ABSTRACT

A method and apparatus for stacking cartons for transport. The apparatus includes a plurality of straddles that engage with stacked cartons. Each straddle attaches to a top edge of a wall on an upper stacked carton and a bottom portion that extends from the top portion to a wall on a lower stacked carton. A cover fits over the upper stacked carton and contacts the straddles in a manner where the bottom portion engages with the upper and lower stacked cartons to prevent the cartons from slipping during transport. In another embodiment straps engage with handles on the side of the carton.

9 Claims, 3 Drawing Sheets

METHOD AND APPARATUS FOR STACKING CARTONS

BACKGROUND OF THE INVENTION

This invention relates a method and apparatus for stacking cartons and more particularly, to straddles that connect to a carton for holding one carton stacked on another carton during movement on a conveyor and/or while being stacked onto a pallet.

Cartons commonly used in the produce industry to hold fruits and vegetables are of a two-piece variety designed to facilitate hand packing. One piece is a box without a top. This piece is for packing a given quantity of the produce by a packer. The second piece of the carton is a box without a bottom whose dimensions are slightly larger than the first piece, and which is designed to be slipped over the packed first piece. Typically, the cartons are available in two standard sizes; one that holds 4/5 of a bushel and a second, half carton size that holds 2/5 of a bushel. The half carton is usually considered a "gift pack" promoted by organizations making fund drives—churches, schools, Boy Scouts, etc.

In conveying the half cartons, the same amount of space is required as for the full carton (4/5 bushel). Thus, only half the volume of produce is being transported. The same holds true for stacking the product manually or on an automatic palletizer; the smaller carton requires twice the number of cartons to form a pallet or unit load for shipment, and running the smaller cartons can easily reduce production 50%. To move the same volume of produce can require extra packinghouse operating hours, since produce is a perishable commodity and time is of essence in a packinghouse operation. Therefore, a packing operation that utilizes the straddle technique to "piggyback" cartons being conveyed to a shipping area can increase volume. In the case of stacking cases on a pallet (by hand or automatic palletizing), a 100% increase in production is realized.

SUMMARY OF THE INVENTION

Among the objects of this invention is to provide a method and apparatus for stabilizing cartons placed on top of other cartons during movement on a conveyor line in a manner which is easily and efficiently integrated into existing production operations of packinghouses without requiring special tools or modification to packing cartons of the type which are presently being used.

It is a further object of this invention to prevent the loss of production volume when transporting cartons of reduced height.

Still another object is to provide an apparatus that is simple, functional, easy to install, disposable and can be manufactured in large quantities at a low per unit cost.

These and other objects are obtained in a method and apparatus for stacking cartons for transport. The method includes the steps of placing an empty bottom of a carton on top of a carton that has been filled and the slip-over top installed. The hood-end of the straddles are then placed on diagonal corners of the top edge of the carton. Alternatively, in the case of side straddles, a straddle is placed on each end and each side of the second carton. The bottom of the straddles (corner or side) are then extended below the bottom of the second carton part way down the side of the first carton. After filling the second carton with produce, the slip-over lid is installed on the second carton. The lid causes the straddle to be pulled tighter to the sides of the second carton thus causing the straddles to clamp the first carton in a combination structure.

Thus it will be appreciated by those skilled in the art that the outside of the walls of the first carton and the second carton engage with the straddles when the cover is placed on the second carton, and when the second carton is stacked on the first carton to prevent the second carton from sliding off the first carton during transport. The cover acts as a securing fasten means to hold the straddles in place while allowing the covers and straddles to be easily removed as well. Using this straddle technique allows the cartons to be stacked during the packing operation and placed on the conveyer while stacked. The carton can then be easily lifted off the conveyor to increase efficiency in produce packing production.

Another preferred embodiment of the invention is a straddle provided that prevents stacked cartons from slipping during transport. The straddle has an elongated base portion with a length longer than the height of the stacked cartons, and a top portion integrally connected to the base portion with a fold portion. The top portion extends parallel to the base portion and has a length less than the height of one of the stacked cartons. The fold portion having a length greater than the thickness of one of the stacked cartons is formed in the straddle so that when the fold portion is placed on the stacked cartons the top portion engages with the inside of one of the stacked cartons and the base portion engage with the outside of the stacked cartons to prevent the stacked cartons from slipping during transport. Preferably, the straddles are placed on opposing corners of the carton, but these straddles may be placed in the middle of the walls of any of the cartons.

In another form of the invention, a method for stacking cartons for transport is provided. In this method a plurality of box-shaped cartons having cutout handles on opposing sidewalls of the carton is provided. Span grips having an elongated intermediate portion with a lower grip on one end and an upper grip on the other end is provided. The upper and lower grip extend inward and away from the intermediate portions. The cartons are then stacked on top of each other with the handles vertically aligned and the lower grip is inserted into the cutout handles of one of the cartons. Next, the upper grip is inserted into the cutout handles in the other carton. The lower grip is drawn to the upper grip so that grips engage with the sidewalls of the upper and lower cartons to prevent the cartons from slipping during transport. Finally, the stacked cartons are transported while the grips are engaging the side walls. Further, the span grips can be quickly and easily attached to the cartons so that when the cartons are lifted after being transported, the stacked cartons may be held together.

DESCRIPTION OF THE PREFERRED EMBODIMENTS

Figure 1:
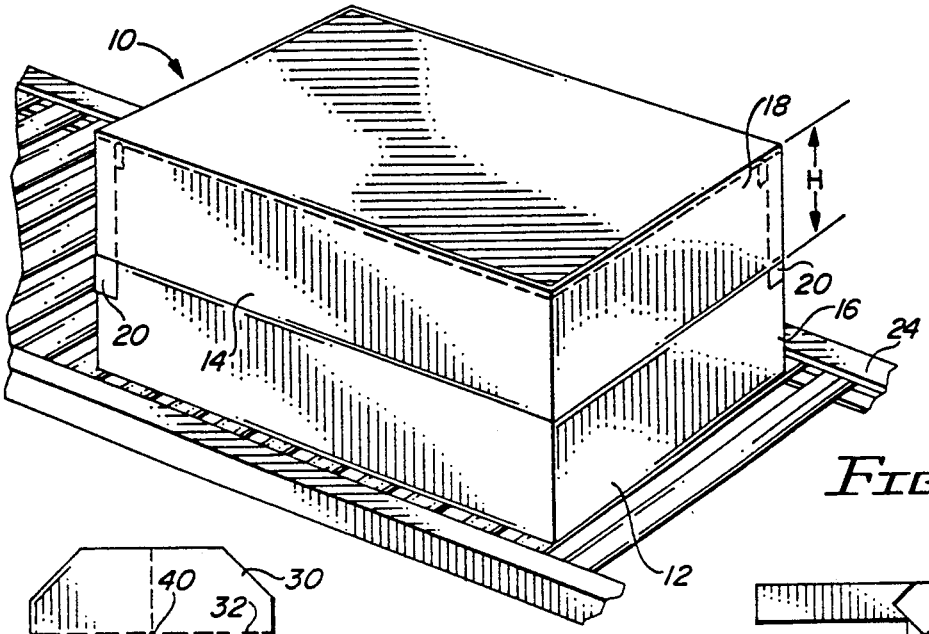
FIG. 1 is a perspective view of stacked cartons using a straddle which incorporates the invention.
Figure 2:
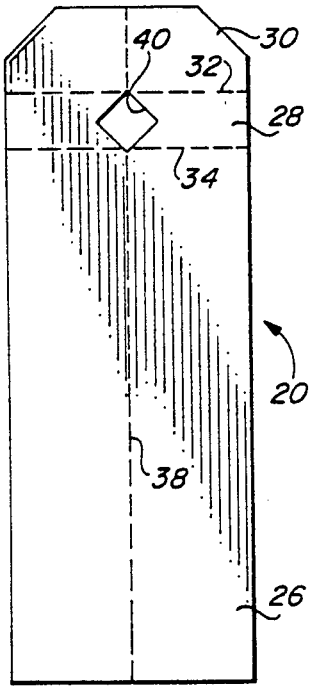
FIG. 2 is a plan view of a blank of a corner straddle which incorporates the invention.
Figure 3:
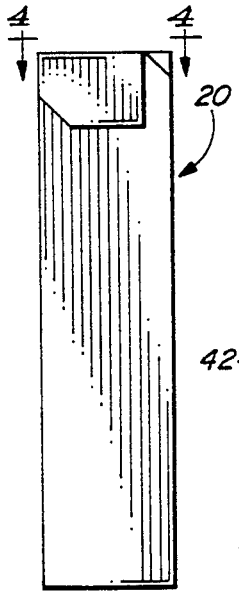
FIG. 3 is a side view of a corner straddle after being formed into its final position.
Figure 4:
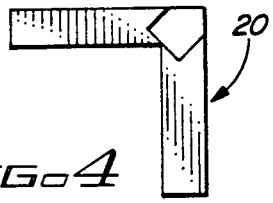
FIG. 4 is a top view of the straddle shown in FIG. 3 along line 4—4.
Figure 5:
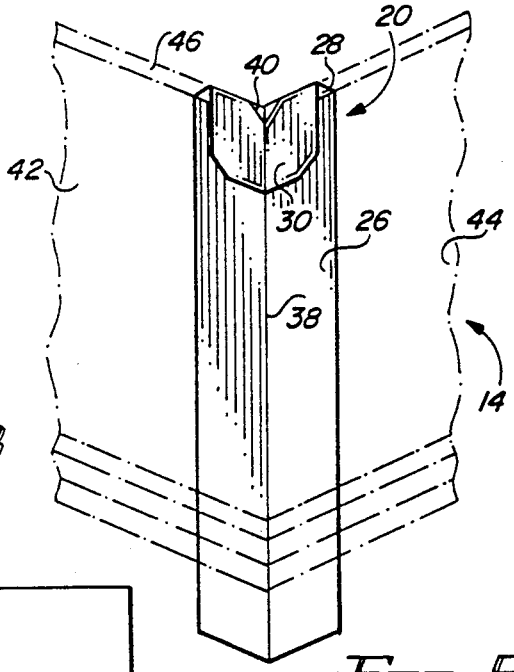
FIG. 5 is a perspective view of the corner straddle in its operational position on stacked cartons.

Referring to FIG. 1 there is shown a system for stacking cartons for transport designated generally by the number 10 having a first bottom carton 12 supporting a second top carton 14. Carton 12 and carton 14 have a top or covers 16 and 18, respectively. Disposed on opposite corners of second top carton 14 between cover 18 and carton 14 are straddles 20. Straddles 20 are held in place on carton 14 by cover 18 to prevent carton 14 from slipping off of carton 12 when transported on conveyor 24.

Referring to FIGS. 2-5, straddle 20 is shown having a elongated bottom portion 26 coupled through a fold portion 28 to top portion 30. Straddle 20 is preferably constructed from a substantially rigid material such as wood or cardboard. However, straddle 20 may be formed in its final shape (FIGS. 3-5) and constructed from plastic. Preferably, the length of bottom portion 26 is longer than the height, designated by H in FIG. 1 of carton 14. Also, the length of top portion 30 is shorter than height H. Fold portion 28 is separated from top portion and bottom portion by scores 32 and 34, respectively.

Score 38 bisects bottom portion 26, fold 28 and top portion 30, and extends from one end of bottom portion 26 to the other end of top portion 30. Notch 40 (which is shown as diamond-shaped, but which can also be other shaped, including rounded) is stamped out of straddle 20 at the intersection of fold 28 and score 38 to permit easy formation of straddle 20, and is fitted to respective corners of carton 14 without being deformed.

Straddle 20 is formed into its operational shape by first folding top portion 30 at an angle of 90° over score 32. Next, top portion 30 and fold 28 are then folded over score 34 at an angle of 90°. Finally, top portion 30, fold 28 and bottom portion 26 are folded 90° about score 38. The completed straddle 20 is then placed in the corner between walls 42 and 44 of carton 14. Fold 28 contacts top edge 46 of side walls 42 and 44. Top portion 30 extends downward to contact the inside of sidewalls 42 and 44, while the bottom portion 26 extends along the outside of sidewalls 42 and 44 downward to sidewalls 42 and 44 of carton 12.

Figure 8:
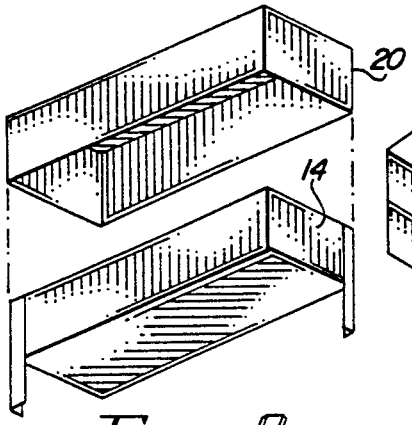
FIG. 8 is a perspective view of a carton with its cover and corner straddle placed thereon.

Referring to FIG. 8, once corner straddles 20 are positioned on opposing corners of carton 14, cover 18 is slid over sidewalls 42 and 44 of carton 14 as well as the outside surface of straddles 20. When cover 18 is slid onto carton 14, the inside surface of the walls on cover 18 engage with straddles 20 to hold them against walls 42 and 44 on carton 14 and cover 16 of carton 12.

Figure 9:
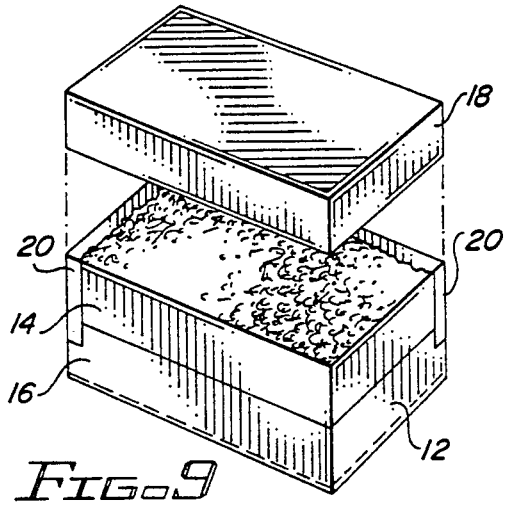
FIG. 9 is a perspective view of stacked cartons incorporating the corner straddle and cover of one of the cartons removed.

Referring to FIG. 9, carton 14 with corner straddles 20 is stacked onto carton 12 with cover 16 installed. Once stacked, cover 18 is slid onto carton 14 forcing straddles 20 to engage with the inside walls of cover 18 and the outside walls of cover 16 to hold a stack of cartons 12 and 14 in place during transport on conveyor 24. Although two straddles 20 are shown in position on opposite corners of cartons 14, any number of straddles may be placed on any of the corners of carton 14.

Figure 6:
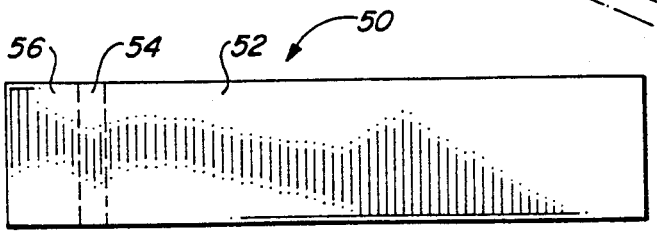
FIG. 6 is a plan view of a blank of an alternate embodiment of a straddle which incorporates the invention.

Referring to FIG. 6, there is shown an alternate embodiment of a straddle, referred to as side straddle 50, having an elongated bottom portion 52 coupled through intermediate fold portion 54 to top portion 56. The dimensions of the length of top portion 56, fold portion 54 and bottom portion 52 are substantially identical to those of straddle 20. Side straddle 5 is constructed by folding top portion 90° about fold portion 54 and then folding fold portion 54 and top portion 56 another 90° about bottom portion 52.

Figure 7:
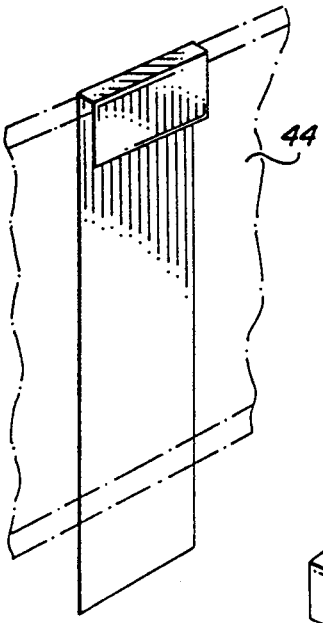
FIG. 7 is a perspective view of the folded straddle shown in FIG. 6 positioned on a carton.
Figure 10:
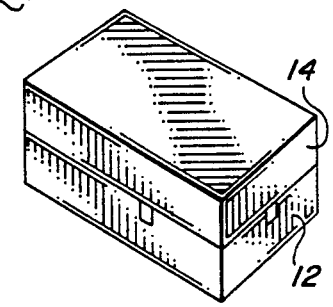
FIG. 10 is a perspective view of stacked cartons incorporating the side straddle in accordance with the present invention.

Referring to FIG. 7, after side straddle 50 is constructed, it is slid onto one of the walls 44 of carton 14 and then placed over carton 12 with cover 16 installed. Cover 18 is then placed over carton 14 forcing bottom portion 52 to engage with the outside walls of top carton 14 and bottom carton 12. Preferably, side straddles 50 are placed on opposite sides and opposite ends of carton 14, as shown in FIG. 10. Side straddles 50 operate similarly to straddles 20 and hold top carton 14 onto bottom carton 12 during transport.

Figure 11:
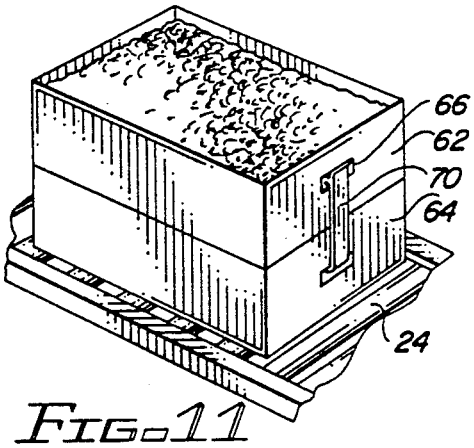
FIG. 11 is a perspective view of alternate embodiment of stacked cartons with holes on their sidewalls and a span grip inserted into the holes to hold the cartons together.

Referring to FIG. 11, there is shown carton 62 adapted for holding a top carton stacked on a bottom carton 64. Cartons 62 and 64 each have a cutout 66 on opposing sidewalls which form handles to permit cartons 62 and 64 to be hand-carried. Span grip 70 engages these sidewalls in cutout 66 to hold cartons 62 and 64 together. This alternate embodiment of a carton uses span grip 70 to prevent cartons 62 and 64 from slipping off of each other when transported on a conveyor 24.

Figure 12:
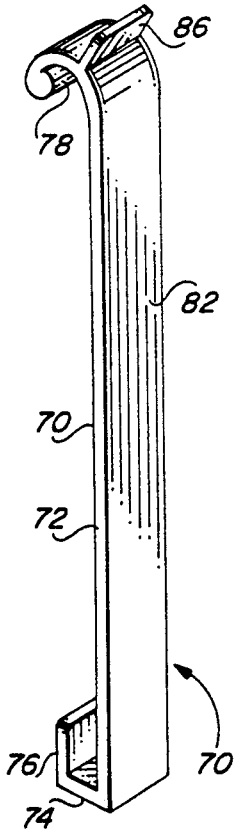
FIG. 12 is a perspective view of the span grips shown in FIG. 11.

Referring to FIG. 12, there is shown a perspective view of span grip 70 having an elongated intermediate portion 72 integrally connected to lower grip 74 which extends inward perpendicularly to the surface of portion 72. Also extending inward from grip 74 is end portion 76. End portion 76, grip 74 and elongated portion 72 form a clamp which mates with the wall and one edge of cutout 66 of lower carton 64.

Disposed at the other end of elongated portion 72 is grip 78 which also extends inward about span grip 70. Extending upward and outwardly on the outer surface of elongated portion 72 is tab 86.

Figure 13:
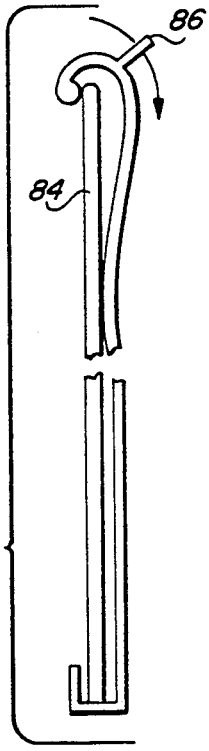
FIG. 13 is a side view of the span grip shown in FIG. 12 as the grips engage with a sidewall of a carton.

Tab 86 is integrally connected to the upper part of elongated portion 72 such that when elongated portion 72 is compressed on outside surface 82 and tab 86 is pulled backward, grip 78 extends above the edge of cutout 66 on carton 62. When tab 86 is subsequently released, grip 78 extends into cutout 66 of carton 62 and grip 78 then engages sidewall edge 84 of carton 62 [FIG. 13].

Preferably, span grip 70 is constructed from a flexible material such as plastic or hardened rubber. Span grip 70 is elastic and flexible so that grip 72 maintains its original shape when flexed and released.

Figure 14:
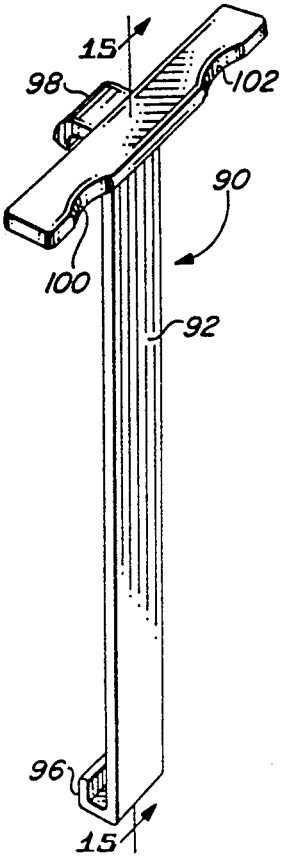
FIG. 14 is a perspective view of an alternate embodiment of the span grip shown in FIG. 12.
Figure 15:
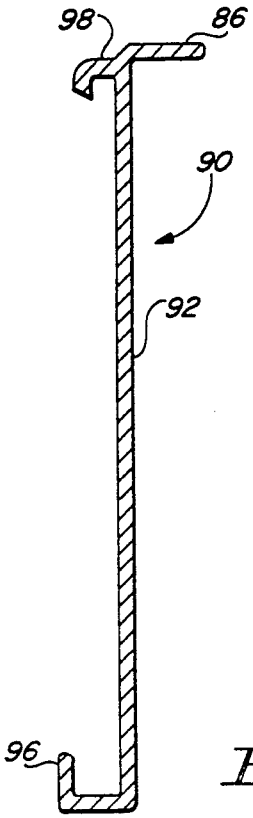
FIG. 15 is a side view of a span grip shown in FIG. 14 along lines 15—15.

Referring to FIG. 14, there is shown an alternate embodiment of span grip 70 shown in FIG. 12. This span grip 90 has an elongated intermediate portion 92 that is connected at on end to grip 94 and end portion 96. At the other end of elongated intermediate portion 92 from grip 94 is an upper grip 98 which extends out and away from elongated intermediate portion 92. Disposed above upper grip 98 is an outwardly extending elongated tab 106. The width of elongated tab 106 is greater than that of elongated intermediate portion 92, and spans outward from both sides of elongated intermediate portion 92. Elongated intermediate portion 106 preferably has curved finger slots 100 and 102 to provide ease in stretching span grip 92. To operate span grip 92, lower grip 94 is inserted into cutout 66 of lower container 64. Next, intermediate portion 92 is stretched upward by pulling up on elongated portion 106 so that grip 98 can be inserted into cutout 66 of carton 62. Elongated tab 106 is then released resulting in upper grip 98 engaging with the walls adjacent cutout 66 and carton 62 being held next to carton 64.

Figure 16:
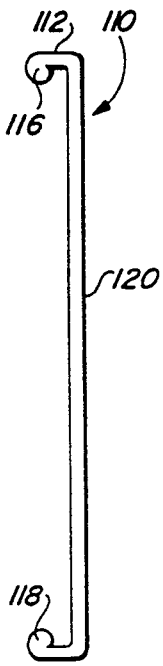
FIG. 16 is a side view of another embodiment of a span grip shown in FIG. 12.
Figure 17:
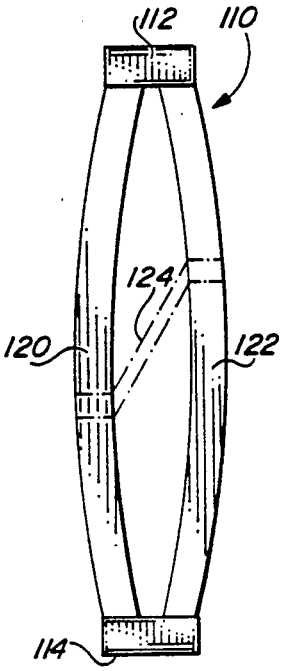
FIG. 17 is a perspective view of a span grip shown in FIG. 16 prior to engaging with a sidewall of a carton.
Figure 18:
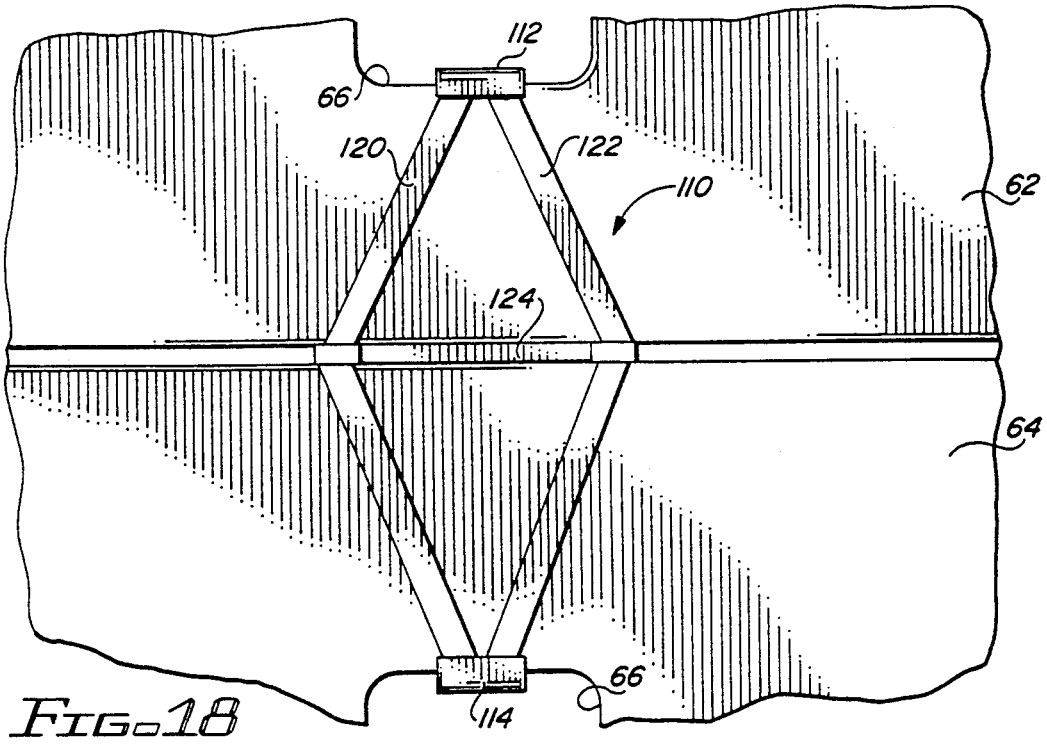
FIG. 18 is a front view of the span grip shown in FIG. 16 as the span grip tightens to engage stacked cartons to hold one carton to another carton.

Referring to FIGS. 16–18, there is shown a second alternate embodiment with span grip 110 having an upper grip 112 and a lower grip 114. Preferably, span grip 110 is constructed from a plastic, rubber or other flexible material. Both the upper grip and lower grip have hooks 116 and 118 respectively that extend inwardly.

Referring to FIGS. 17 and 18, extending between upper grip 112 and lower grip 114 are elongated intermediate portions 120 and 122, generally referred to as bar span straps. Intermediate portions 120 and 122 flex inward and outward about their middle portion to shorten the distance between upper grip 112 and lower grip 114.

A lateral tension strap 124 extends between the middle of intermediate portions 120 and 122 and is pivotly fastened with a clamp, or is integrally connected to intermediate portion 120. The other end of lateral tension strap 124 is slidably coupled to intermediate portion 122. Lateral tension strap 124 is rigid and maintains intermediate portions 120 and 122 apart about their middle to draw upper grip 112 closer to lower grip 114.

Upper grip 112 attaches to the sidewall of carton 64 and lower grip 114 attaches to the sidewall of carton 64 above cutout 66. When grips 112 and 114 are placed into cutout 66, lateral tension strap 124 extends substantially parallel to intermediate portions 120 and 122. Lateral tension strap 124 is then pushed to an orientation substantially perpendicular to intermediate portions 120 and 122. When strap 124 is oriented perpendicularly to intermediate portions 120 and 122, upper grip 112 is drawn toward lower grip 114 to engage with the walls adjacent cutout 62. Cartons 62 and 64 are then held together with grip 110 during transport.

Straddles 20 and 50, straps 70, or span grip 110 are connected to engage with cartons while produce is being packed. Once the straddles, straps or span grips are connected, it is evident that the stacked cartons will be held together and will be prevented from slipping while being transported.

Although attaching straddles, straps or span grip 110 to cartons on a conveyer when packing produce is pictured, they may also be attached during other phases of the packing operation.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for stacking cartons for transport comprising the steps of:

providing a first and a second carton, each having a bottom and a first, a second, a third, and a fourth side wall, each of said side walls having an outside surface, a top edge, a bottom edge, and a height;

stacking the second carton onto the first carton, extending the side walls of the second carton substantially coplanar to the side walls of the first carton;

providing a first and a second straddle, each having an elongated base portion having a length larger than the height of one of the side walls and a top portion having a length shorter than the height of one of said side walls;

placing the first straddle on the first side wall of the second carton such that said top portion contacts the top edge of the first side wall of the second carton and the elongated portion extends parallel to the first side wall of the second carton along the outside surface from the top edge of the first side wall past the bottom edge of the first side wall of the second carton;

placing the second straddle on the second side wall of the second carton such that said top portion contacts the top edge of the second side wall of the second carton and the elongated portion extends parallel to the second side wall of the second carton along the outside surface form the top edge of the second side wall of the second carton past the bottom edge of the second side wall of the second carton; and placing a cover having a ceiling and four side walls, each having an inside surface, over both the outside surfaces of the side walls of the second carton and the straddles such that the inside surfaces of the side walls of the cover engage the straddles to hold the straddles against the outside surfaces of the second carton side walls, the straddles extending over the outside surfaces of the first carton side walls to prevent the second carton from sliding off the first carton during transport.

2. A straddle for preventing stacked cartons from slipping during transport, each of said cartons having a height, an inside, and an outside, the straddle comprising an elongated base portion having a length longer than the height of one of the stacked cartons and further having an end;

a top portion integrally connected to said base portion with a fold portion, said top portion extending parallel to said base portion and having a length less than the height of one of the stacked cartons and further having an end; and said fold portion having a length greater than the height of one of the stacked cartons such that when said fold portion is placed on one of said stacked cartons said top portion engages with the inside of one of the stacked cartons and said base portion engages the outside of the stacked cartons to prevent the stacked cartons from slipping during transport.

3. The straddle as reviewed in claim 2 further comprising a lateral score extending laterally along said straddle from the end of the base portion through said fold portion to the end of said top portion.

4. The straddle as reviewed in claim 3 further comprising a notch cut out of said fold portion along said lateral score to provide ease in folding said straddle along said lateral score.

5. The straddle as recited in claim 3 wherein said lateral score bisects said straddle laterally.

6. A system for stacking cartons for transport comprising:

a first carton and a second carton, each having four vertically oriented walls, each of said walls having an outside surface and an inside surface, and a horizontally oriented floor, said cartons being stacked on top of each other with the first carton on bottom and the second carton on top;

a plurality of straddles engaging opposite ones of said walls on said top carton, said straddles each having an elongated bottom portion that extends vertically along the outside surface of one of the walls on the top carton and partially along the outside surface of one of the walls of the bottom carton, said bottom portion meeting a top portion at a fold portion which extends over a top edge of one of the walls, the top portion extending parallel to said bottom portion along the inside surface of one of said walls;

a cover having four vertically oriented walls, each of said walls having an inner and an outer surface, and a horizontally oriented ceiling, said cover extending over said top carton such that said cover's vertically oriented walls enclose walls of said top carton, enclosing the outer surface of the walls of the top carton, engaging each of said straddles to hold said bottom portion against the inner surface of one of the top cover's walls and the outer surface of one of the walls of the bottom container to prevent the top carton from siding off the bottom carton during transport.

7. The system as recited in claim 6 wherein said fold portion extends perpendicularly between said bottom portion and said top portion.

8. The system as recited in claim 7 wherein each of said straddles includes a score that extends laterally along said straddle substantially bisecting said bottom portion, said fold portion, and said top portion.

9. A method for stacking cartons for transport comprising the steps of:

providing a first and a second carton, each having a bottom and a first, a second, a third, and a fourth side wall, each of said side walls having an outside surface, a to edge, a bottom edge, and a height, the first and the second carton each having a first, a second, a third, and a fourth corner formed by the for side walls;

stacking the second carton onto the first carton, extending the side walls of the second carton substantially coplanar to the side walls of the first carton, so that the first corner of the second carton substantially aligns with the first corner of the first carton and the second corner of the second carton substantially aligns with the second corner of the first carton;

providing a first and a second straddle, each having an elongated base portion having a length larger than the height of one of the side walls and a top portion having a length shorter than the height of one of the side walls, the first and the second straddle each having an inner surface;

forming a first fold in the first straddle, folding the top portion onto the base portion of the first straddle, such that the inner surface of the first straddle is at the interior of the first fold; 'forming a second fold in the first straddle laterally, such that the top portion of the first straddle is at the interior of the second fold;

forming a first fold in the second straddle, folding the top portion onto the base portion of the second straddle, such that the inner surface of the second straddle is at the interior of the first fold;

forming a second fold in the second straddle laterally, such that the top portion of the second straddle is at the interior of the second fold;

lacing the top portion of the first straddle over the top edge of the second carton at the first corner of the second carton, aligning the second fold along the first corner of the second carton and extending the base portion of the first straddle along the first corner of the second carton and over the first corner of the first carton;

placing the top portion of the second straddle over the top edge of the second carton at the second corner of the second carton, aligning the second fold along the second corner of the second carton and extending the base portion of the second straddle along the second corner of the second corner and over the second corner of the first carton; and placing a cover having a ceiling and four side walls, each having an inside surface, over both the outside surfaces of the side walls of the second carton and the straddles such that the inside surfaces of the side walls of the cover engage the straddles to hold the straddles against the outside surfaces of the second carton side walls, the straddles extending over the outside surfaces of the first carton side walls to prevent the second carton from sliding off the first carton during transport.

* * * * *